United States Patent [19]

Takahashi

[11] Patent Number: 4,982,887

[45] Date of Patent: Jan. 8, 1991

[54] TAG SIZE DIFFERENTIATING SYSTEM FOR CONTINUOUS TAG PRINTING MACHINES

[75] Inventor: Mitsuharu Takahashi, Kanagawa, Japan

[73] Assignee: Kabushiki Kaisha Sato, Japan

[21] Appl. No.: 744,403

[22] Filed: Jun. 13, 1985

Related U.S. Application Data

[63] Continuation of Ser. No. 492,390, May 6, 1983, abandoned.

[30] Foreign Application Priority Data

May 11, 1982 [JP] Japan ..... 57-77561

[51] Int. Cl.[5] ..... B65H 43/08; B41J 15/06; B41L 45/12

[52] U.S. Cl. ..... 226/24; 33/735; 101/73

[58] Field of Search ..... 226/10, 24, 27, 33, 226/37, 43, 152, 156, 2; 33/125 M, 129, 132 R, 132 A, 133, 134 R, 141 R, 141 B, 141.5, 142, 711, 712, 734, 735, 772, 773, 778; 101/73, 74, 75, 66; 242/57; 73/157

[56] References Cited

U.S. PATENT DOCUMENTS

| | | | |
|---|---|---|---|
| 2,290,871 | 7/1942 | Freedman | 101/66 X |
| 2,742,282 | 4/1956 | Ervin et al. | 101/66 X |
| 2,824,736 | 2/1958 | Allen | 101/66 X |
| 2,968,236 | 1/1961 | Swett | 101/66 X |
| 3,050,857 | 8/1962 | Pierce et al. | 33/141 B |
| 3,392,895 | 7/1968 | Ellner et al. | 226/152 X |
| 3,558,862 | 1/1971 | McMillan | 73/157 |
| 3,591,776 | 7/1971 | Sylvester | 33/141 R X |
| 3,721,809 | 3/1973 | Strandberg, Jr. et al. | 242/57 X |
| 4,002,279 | 1/1977 | Klein | 226/2 |
| 4,040,345 | 8/1977 | Adams et al. | 101/66 |
| 4,196,665 | 4/1980 | Rogers et al. | 101/66 |
| 4,316,566 | 2/1982 | Arleth et al. | 226/2 |
| 4,453,823 | 6/1984 | Sagita et al. | 226/33 X |

OTHER PUBLICATIONS

Davis, W. M. and R. E. Yates *Label Printer, IBM Technical Disclosure Bulletin, vol. 16, No. 4, Sep. 1973, pp. 1149–1150.*

*Primary Examiner*—Harvey C. Hornsby
*Assistant Examiner*—Scott J. Haugland
*Attorney, Agent, or Firm*—Ostrolenk, Faber, Gerb & Soffen

[57] ABSTRACT

A tag size differentiating system for tag printing machines. The system determines the length of tags in a continuous tag web consisting of a series of identical tags having one of a predetermined set of possible lengths. The system includes means for monitoring the distance the continuous tag web is advanced and sensing means for detecting indicia separating the individual tags. The system comprises a CPU and a memory for storing the possible tag lengths. The CPU determines the distance the tag web is advanced form the time and indicia is detected until the next indicia is detected and compares this distance to the possible tag length. Onthe basis of the comparison, the CPU determines the length of the individual tags in the tag web. The system does not begin the length determining process until the indicia at the trailing end of the initial tag is detected to prevent erroneous length measurements.

15 Claims, 2 Drawing Sheets

TAG SIZE DIFFERENTIATING SYSTEM FOR CONTINUOUS TAG PRINTING MACHINES

This is a continuation of application Ser. No. 492,390, now abandoned, filed on May 6, 1983 in the name of Mitsuhara Takahashi for Tag Size Differentiating System for Continuous Tag Printing Machines.

BACKGROUND OF THE INVENTION

1. Field of the Invention

The present invention relates to a continuous tag printing machine and, more particularly, to a system for automatically differentiating the longitudinal sizes of tags which are charged in the form of a continuous web into the continuous tag printing machine.

2. Description of the Prior Art

A printing machine using a continuous tag web as its printing medium is charged with continuous tags of various sizes, which are selected in accordance with either the amount of indicia to be printed or a printing format. Moreover, it is necessary to determine at the printing machine whether the sizes of the continuous tags charged correspond to the size and placement of their printed contents. It, therefore, becomes essential to differentiate among various tag sizes.

For the aforementioned tag sizes, the widthwise or transverse sizes can be automatically differentiated on the basis of tag sensing signals coming from respective sensors by fixing one side of the continuous tag web, and by arranging a desired number of sensors in the vicinity of the other side of the continuous tag web arrayed in the transverse direction. However, the longitudinal sizes of the tags are difficult to automatically differentiate. Therefore, it is customary for the operator to feed the longitudinal sizes to the printing machine as inputs by the use of a switch, an input key or the like.

This is disadvantageous in that it is necessary to input the longitudinal tag sizes for each replacement continuous tag web. Another disadvantage is that an erroneous feeding operation will frequently cause improper printing of tags or the inability to print tags altogether.

SUMMARY OF THE INVENTION

The present invention has been conceived because of the aforementioned disadvantages within the prior art. It is, therefore, an object of the present invention to provide a tag size differentiating system for automatically differentiating the longitudinal tag sizes of a continuous tag web that has been charged into a tag printing machine.

According to one aspect of the present invention, a tag size differentiating system is provided for use with a continuous tag printing machine for printing a continuous tag web having a sensing portion for each tag. In the presently preferred embodiment, the tag size differentiating system comprises: a pair of delivery rollers cooperatively actuated with respect to each other for delivering the continuous tag web, a motor for rotatably driving the delivery rollers, a counter for counting the rotations of said motor, a sensor for sensing the sensing portions of the continuous tag web to sequentially generate a series of output signals, and a differentiator for distinguishing the longitudinal tag sizes on the basis of the values of the counter which are counted between the two series output signals from the sensor.

More generally, the present invention is directed towards a machine for determining the length of individual tags forming part of a continuous tag web, the web having equally spaced indicia thereon, the spacing of the indicia being indicative of the length of the individual tags, the machine including: a sensor for generating an indicia detect signal whenever one of the indicia is located at a predetermined position, a web advancing mechanism for advancing the web past the sensor and a circuit for monitoring the distance the web advancing mechanism has moved the web and for determining which of at least two possible lengths the tags are as a function of the distance the web advancing mechanism has moved the web and the number of indicia detect signals the sensor has generated.

BRIEF DESCRIPTION OF THE DRAWINGS

Other objects and features of the present invention will become apparent from the following description taken in conjunction with the accompanying drawings, in which.

DESCRIPTION OF THE PREFERRED EMBODIMENT

The present invention will now be described in detail with reference to the accompanying drawings.

Figure 1:
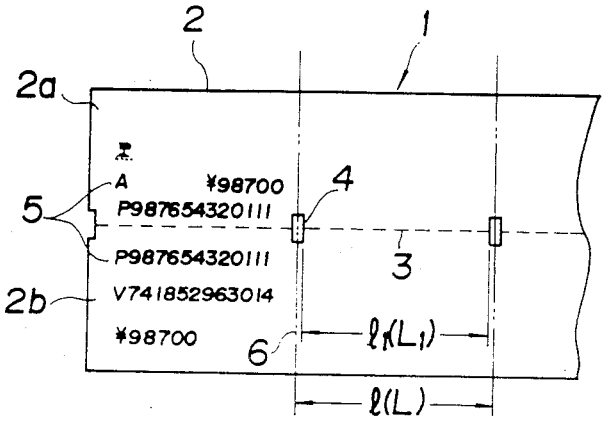
FIG. 1 is a plan view of a portion of a continuous tag web.

In FIG. 1, a number of series tags in the form of a continuous tag web 1 is shown as an example. This continuous tag web 1 is formed at its transverse center with longitudinally extending perforations 3. Sensing holes 4 are formed as detection portions at intervals corresponding to a sheet of tags 2. The cut lines 6 indicated by double-dotted lines are the lines on which the continuous tag web 1 is cut after its tags 2 have been printed with indicia 5. When cutting operations are performed along those cut lines 6, the continuous tag web 1 is divided into tags, i.e., into sheets of separate tags 2, and each of these tags is further divided into a portion 2*a*, e.g. for a customer, and a portion 2*b*, e.g. for data processing, when the tag is cut along the perforations 3.

Figure 2:
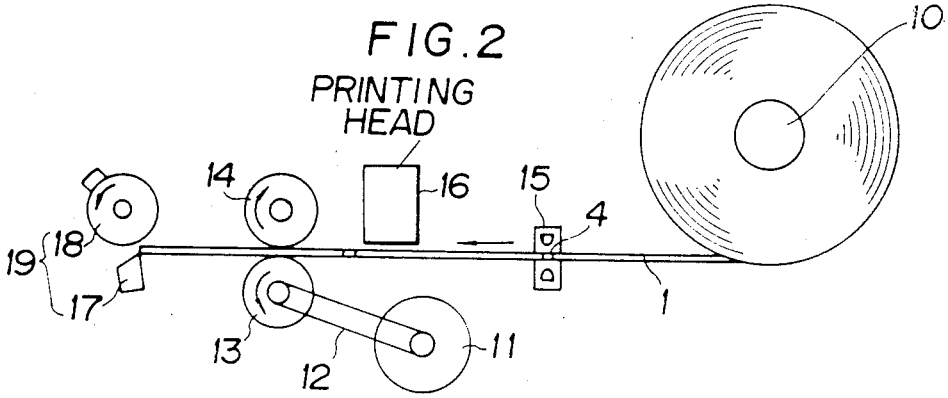
FIG. 2 is a side elevational view illustrating the arrangement of a printing machine.

The continuous tag web 1 is charged into the machine in the manner illustrated in FIG. 2, i.e., it is wound upon a tag holder 10 of the printing machine. The continuous tag web 1 dispensed from the tag holder 10 is delivered by the cooperative action of a pair of delivery rollers 13 and 14 which are rotatably drive by a pulse motor 11 through an endless timing belt 12. During the delivery of the web, the sensing holes 4 of the continuous tag web 1 are sensed by a photoelectric sensor 15 and the desired indicia 5 are printed on the continuous tag web 1 by the action of a printing head 16 of a thermal, electrostatic or drum impact type. Then, the printed continuous tag web 1 is cut on its respective cutting lines 6 by a cutter 19 which is comprised of a stationary blade 17 and a cooperating rotary blade 18.

Figure 3:
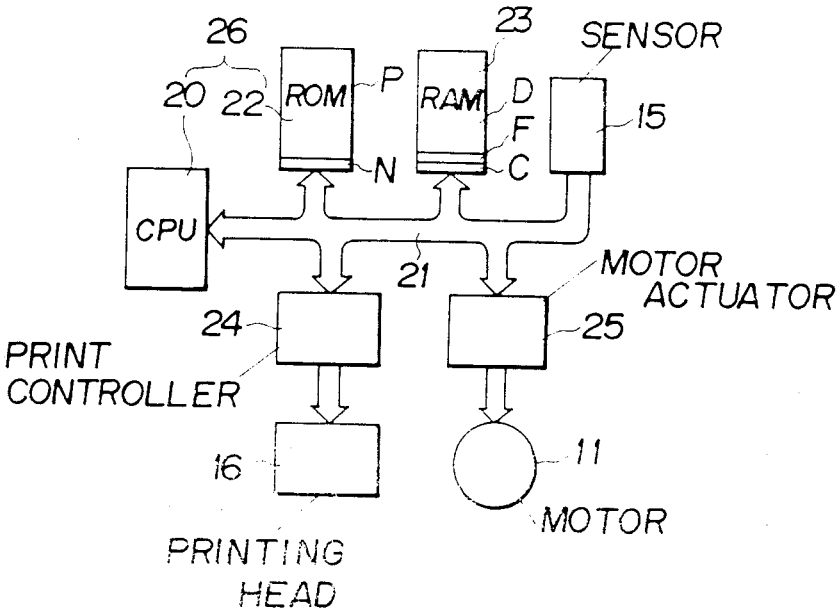
FIG. 3 is a schematic block diagram illustrating a control circuit for controlling the printing machine of FIG. 2.

The control circuit illustrated in FIG. 3 entirely controls the entire printing machine. A central processing unit (i.e., CPU) 20 is connected through a bus 21 with a read only memory (i.e., ROM) 22 and with a random access memory (i.e., RAM) 23. The ROM 22 stores a program P and a value N for providing a reference for differentiating the longitudinal tag sizes. Moreover, the RAM 23 is composed of a data memory D with stored printing data, a flag F and a counter C. The flag F and counter C may be arranged as independent circuits and may be connected with the bus 21 without making use of the portions of the RAM 23. A print controller 24 for regulating the printing operations by the printing head 16, a motor actuator 25 for driving and regulating the pulse motor 11, and the sensor are also connected with bus 21. Additionally, the differentiations of the longitudinal tag sizes are detected on the basis of the counted values of the counter C by the action of a differentiator 26 which is composed of the CPU 20 and the ROM 22.

Figure 4:
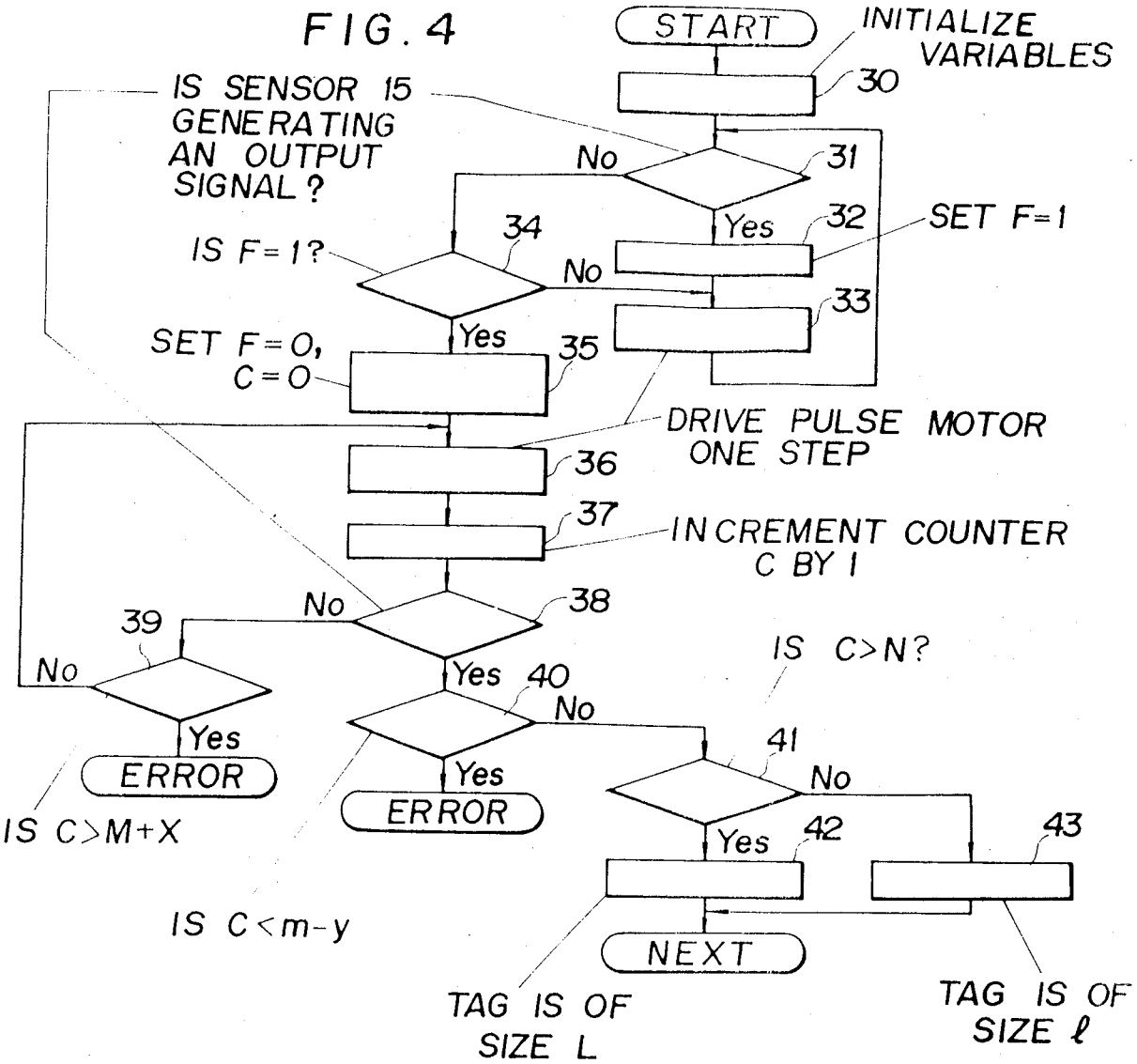
FIG. 4 is a schematic flow chart illustrating operating modes for differentiating tag sizes.

The operations for differentiating the longitudinal or continuous size of the portion corresponding to one tag 2 of the continuous tag web 1 illustrated in FIG. 1 are now described with reference to FIG. 4. In this description, it is assumed that there are two continuous tag webs 1 having longitudinal sizes l and L, respectively, and that the pulse motor 11 requires m and M steps, respectively, to deliver the continuous tag webs 1 of the sizes l and L by distances $l_1$ and $L_1$ between the respective two sensing holes 4 (wherein: $l<L$; $l_1<L_1$; and $m<N<M$).

When the size differentiating operation begins, the flag F and the counter C are reset to an initial setting (step 30). At this initial setting step, both the flag F and the counter C are set to the binary "0" level. The program then determines whether an output signal from the sensor 15 has been generated (step 31). Before a hole 4 reaches the sensor 15, the sensor 15 will not have generated an output signal. As a result, the program proceeds to step 34 where it determines if the flag F is set at the binary "1" level. Since it has been initially set at the binary "0" level, the program will proceed to step 33 which causes the pulse motor 11 to be driven one step so as to advance the continuous tag web 1. At this point, the program returns to step 31 and again determines if an output signal has been generated by the sensor 15. As long as the hole 4 has not reached the sensor 15, an output signal will not be generated and the program will continue to cycle through steps 31, 34 and 33.

When the front edge of a hole 4 finally reaches sensor 15, an output signal will be generated by sensor 15, and the answer to the questions set forth in step 31 will be yes. At this point, the program will proceed to step 32 which causes the flag F to be set to the binary "1" level. The program will then proceed to step 33 to cause the pulse motor 11 to be driven an additional step (thereby further advancing the tag web 1). The program will continue to cycle through steps 31, 32 and 33 until the rear end of the hole 4 reaches the sensor 15. At this point, the answer to the question set forth in step 31 will be no and the program will proceed to step 34. Since the flag F is now set at the binary "1" level, the program will know that it has detected the end of the hole 4 and will now proceed to step 35. At this point, the flag F and the counter C are reset to the binary "0" level. At this point, the program is ready to determine the length of the tags 2 of the web 1.

Proceeding to step 36, the program causes the pulse motor to be driven one step thereby advancing the web 1. In step 37, the program increments the counter C by one corresponding to the single step which the pulse motor has advanced the web. Proceeding to step 38, the program determines if the sensor 15 has generated an output signal. If it has not, this indicates that the sensor is located on a portion of the web between two adjacent holes 4 and the program proceeds to step 39 where it determines if the count C is greater than the predetermined value M+X. The value M+X is chosen to be sufficiently large that if the count C is greater than that value, an error has occurred. In such a case, the program proceeds to the step ERROR which will cause an appropriate indication of the error (e.g., an alarm) to be provided. If the value of the counter C is less than M+X, the program returns to step 36. The program will continue proceeding through steps 36, 37, 38 and 39 until the left-hand edge (as viewed in FIG. 1) of a hole 4 reaches the sensor 15. At this point, the sensor will generate an output signal (step 38) and the program will proceed to step 40. In step 40, the program determines if the count value C is less than a predetermined value m−y. This value is selected to be sufficiently small that if the count value C is less than this value, an error will have occurred. In such a case, the program proceeds to the ERROR step and provides a visual and/or audio indication of the error. Presuming that an error has not occurred, the program proceeds to instruction block 41 and determines if the count value C is greater than N which is selected to be a number somewhere between the value of count C which corresponds to the tag having a longitudinal size L and a tag having a longitudinal size l. If C is greater than N, the program proceeds to step 42 and determines that the tag is of size L. If C is not greater than N, the program proceeds to step 43 and determines that the tag is of size l.

In the embodiment described above, the continuous tag sizes are differentiated in terms of that number of the steps of the pulse motor 11, which is required to deliver the continuous tag web 1 shown in FIG. 1, by a distance between the right-hand end of a certain sensing hole 4 and the left-hand end of the next sensing hole 4. However, that longitudinal size differentiation can also be conducted in terms of that number of the steps of the pulse motor 11 which is required to deliver the continuous tag web 1 either by a distance between the respective left-hand or right-hand ends of the two adjacent sensing holes 4 or by a distance between three or more sensing holes 4.

In accordance with another modification, the differentiation of the tag sizes can also be conducted by using a servo motor in place of the pulse motor 11 by intermittently rotating the servo motor at an interval of a reference angle and by counting the number of the rotations in place of the number of the steps.

Moreover, the embodiment thus far described is exemplified as differentiating the two kinds of continuous tag webs 1 having the longitudinal tag sizes l and L. However, if a plurality of reference values corresponding to the value N are set and if the decisions corresponding to that in the step 41 are executed for the respective reference values, it is also possible to differentiate three or more kinds of continuous tag webs 1.

As has been described above, the tag size differentiating system according to the present invention is especially arranged to automatically differentiate the longitudinal tag sizes of the continuous tag web 1 charged thereinto. As a result, it is not necessary to execute the complicated and unreliable operations in which the tag sizes are fed as inputs by means of a switch or an input key each time the continuous tag webs 1 are interchanged. Since the tag sizes of the charged continuous tag web 1 are correctly differentiated, it is moreover possible to differentiate without error, whether or not the tag sizes and the printed contents correspond to each other.

The present invention may be embodied in other specific forms without departing from the spirit or essential attributes thereof and, accordingly, reference should be made to the appended claims, rather than to the foregoing specification as indicating the scope of the invention.

I claim:

1. A machine for determining the length of individual tags forming part of a continuous tag web, said continuous tag web having equally spaced indicia thereon, each of said indicia having a leading portion, a trailing portion, and a central portion, the spacing of said indicia being indicative of the length of said individual tags, said machine comprising:

(a) a sensor for generating an indicia detect signal whenever any portion of one of said indicia is adjacent said sensor;

(b) a web advancing mechanism for advancing said web past said sensor; and (c) a circuit for detecting indicia detect signals generated by said sensor, monitoring the movement of said web by said web advancing mechanism, and determining which of at least two possible lengths said tags are, as a function of both the distance said web advancing mechanism has moved said web between a trailing portion of one and a leading portion of another of said length-indicating indicia, and the indicia detect signals said sensor has generated;

(d) the monitoring of said web movement commencing with the termination of an initial indicia detect signal corresponding to a trailing portion of an initial one of such indicia, and said circuit being inoperative for determining such lengths until such termination of such initial indicia detect signal, such that said movement is not monitored prior to or during generation of such initial indicia detect signal.

2. A machine for determining the length of individual tags forming part of a continuous tag web, said continuous tag web having equally spaced indicia thereon, each of said indicia having a leading portion, a trailing portion, and a central portion, the spacing of said indicia being indicative of the length of said individual tags, said machine comprising:

(a) a sensor for generating an indicia detect signal whenever any portion of one of said indicia is adjacent said sensor;

(b) a web advancing mechanism for advancing said web past said sensor; and (c) a circuit for detecting indicia detect signals generated by said sensor, monitoring the movement of said web by said web advancing mechanism, and determining which of at least two possible lengths said tags are, as a function of both the distance said web advancing mechanism has moved said web between a trailing portion of one of said indicia and a leading portion of another of said indicia, and as a function of the indicia detect signals said sensor has generated;

(d) the monitoring of said web movement commencing with the termination of an initial indicia detect signal corresponding to a trailing portion of an initial one of such indicia, and said circuit being inoperative for determining such lengths until such termination of such initial indicia detect signal, such that said movement is not monitored prior to or during generation of such initial indicia detect signal;

wherein the circuit includes means for storing a flag, initializing said flag to an initial value maintaining said flag at said initial value prior to generation of said initial indicia detect signal, setting said flag to a second value during the generation of said initial indicia detect signal, and beginning the monitoring of said movement upon the termination of said initial indicia detect signal on the condition that said flag is set to said second value.

3. The machine of claim 2, wherein said web advancing mechanism includes a stepping motor and wherein said circuit determines the length of said tags as a function of the number of steps said motor is driven through between the time said sensor generates successive indicia detect signals.

4. The machine of claim 3, wherein said web advancing mechanism further includes a pair of rollers which coact with each other to advance said web, said stepping motor driving at least one of said rollers.

5. The machine of claim 3, wherein a respective one of said indicia is associated with each said tag.

6. The machine of claim 2, wherein said circuit determines the exact length of said tags as a function of the distance said web advancing mechanism has moved said web and the number of indicia detect signals said sensor has generated.

7. The machine of claim 2 in which the circuit comprises memory means for storing at least one reference value and differentiating means for obtaining a count value as a function of said movement and said indicia detect signals and for determining which of said possible lengths said tags are, on the basis of a comparison between said count value and said reference value.

8. A machine for determining the length of individual tags forming part of a continuous tag web; said continuous tag web having spaced indicia thereon; each of said indicia having a leading portion, a trailing portion, and a central portion; said individual tags each having a length which is one of at least two distinct possible lengths; and the spacing between the trailing portion of one and the leading portion of another of said indicia being indicative of the length of at least one of said individual tags; said machine comprising:

(a) a sensor for generating an indicia detect signal whenever any portion of one of said indicia is adjacent said sensor;

(b) a web advancing mechanism for advancing said web past said sensor; and (c) a circuit for detecting indicia detect signals generated by said sensor, monitoring the distance said web advancing mechanism has moved said web between a trailing portion of one and a leading portion of another of said length-indicating indicia, and determining from said distance which of said at least two distinct possible lengths is the length of said at least one of said tags; said circuit comprising (i) memory means for storing at least one reference value; and (ii) differentiating means for obtaining a count value which is a function of said distance and for determining which of said possible lengths is the length of said at least one of said tags by comparing said count value and said reference value;

(d) said circuit being inoperative for obtaining said length-determining count value until the termination of an initial indicia detect signal corresponding to a trailing portion of an initial one of such indicia, such that said count value and thereby said length is not obtained prior to or during generation of such initial indicia detect signal.

9. A machine for determining the length of individual tags forming part of a continuous tag web; said continuous tag web having spaced indicia thereon; each of said indicia having a leading portion, a trailing portion, and a central portion; said individual tags each having a length which is one of at least two distinct possible lengths; and the spacing between the trailing portion of one of said indicia and the leading portion of another of said indicia being indicative of the length of at least one of said individual tags; said machine comprising:

(a) a sensor for generating an indicia detect signal whenever any portion of one of said indicia is adjacent said sensor;

(b) a web advancing mechanism for advancing said web past said sensor; and (c) a circuit for detecting indicia detect signals generated by said sensor, monitoring the distance said web advancing mechanism has moved said web between a trailing portion of one and a leading portion of another of said length-indicating indicia, and determining from said distance which of said at least two distinct possible lengths is the length of said at least one of said tags; said circuit comprising (i) memory means for storing at least one reference value; and (ii) differentiating means for obtaining a count value which is a function of said distance and for determining which of said possible lengths is the length of said at least one of said tags by comparing said count value and said reference value;

(d) said circuit being inoperative for obtaining said length-determining count value until the termination of an initial indicia detect signal corresponding to a trailing portion of an initial one of such indicia, such that said count value and thereby said length is not obtained prior to or during generation of such initial indicia detect signal; wherein the differentiating means includes means for storing a flag, initializing said flag to an initial value, maintaining said flag at said initial value prior to generation of said initial indicia detect signal, setting said flag to a second value during the generation of said initial indicia detect signal, and beginning the obtaining of said count value upon the termination of said initial indicia detect signal on the condition that said flag is set to said second value.

10. The machine of claim 9 in which said circuit further comprises error checking means for comparing said count value with a predetermined maximum value and with a predetermined minimum value and for determining that an error has occurred if said count value exceeds said maximum value or if said count value is less than said minimum value; said differentiating means being operative for determining which of said possible lengths is the length of said corresponding one of said tags only if no error is detected by said error checking means.

11. A machine for determining the length of individual tags forming part of a continuous tag web; said continuous tag web having spaced indicia thereon; each of said indicia having a leading portion, a trailing portion, and a central portion; said individual tags each having a length which is one of at least two distinct possible lengths; and the spacing between the trailing portion of one and the leading portion of another of each adjacent pair of said indicia being indicative of the length of at least one of said individual tags; said machine comprising:

(a) a sensor for generating an indicia detect signal whenever any portion of one of said indicia is adjacent said sensor;

(b) a web advancing mechanism for advancing said web past said sensor; and (c) a circuit for detecting indicia detect signals generated by said sensor, monitoring the distance said web advancing mechanism has moved said web between a trailing portion of one and a leading portion of another of said length-indicating indicia, and determining from said distance which of said at least two distinct possible lengths is the length of said at least one of said tags; said circuit comprising (i) memory means for storing at least one reference value; and (ii) differentiating means for obtaining a count value which is a function of said distance and for determining which of said possible lengths is the length of said at least one of said tags by comparing said count value and said reference value;

(d) said circuit being inoperative for obtaining said length-determining count value until the termination of an initial indicia detect signal corresponding to a trailing portion of an initial one of such indicia, such that said count value and thereby said length is not obtained prior to or during generation of such initial indicia detect signal; and (e) error checking means for comparing said count value with a predetermined maximum value and with a predetermined minimum value and for determining that an error has occurred if said count value exceeds said maximum value or if said count value is less than said minimum value; said differentiating means being operative for determining which of said possible lengths is the length of at least one of said tags only if no error is detected by said error checking means.

12. The machine of claim 9, wherein the differentiating means includes means for initializing said count value to an initial value and maintaining said count value at said initial value until said obtaining of the count value is begun.

13. The machine of claim 2, wherein the circuit includes means for storing a movement value which is indicative of said movement, initializing said movement value to an initial value, and maintaining said movement value at said initial value until said monitoring of said movement is begun.

14. A machine for determining the length of individual tags forming part of a continuous tag web; said continuous tag web having spaced indicia thereon; each of said indicia having a leading portion, a trailing portion, and a central portion; said individual tags each having a length which is one of at least two distinct possible lengths; and the spacing between the trailing portion of one and the leading portion of another of each adjacent pair of said indicia being indicative of the length of at least one of said individual tags; said machine comprising:

(a) a sensor for generating an indicia detect signal whenever any portion of one of said indicia is adjacent said sensor;

(b) a web advancing mechanism for advancing said web past said sensor; and (c) a circuit for detecting indicia detect signals generated by said sensor, monitoring the distance said web advancing mechanism has moved said web between a trailing portion of one and a leading portion of another of said length-indicating indicia, and determining from said distance which of said at least two distinct possible lengths is the length of said at least one of said tags; said circuit comprising (i) memory means for storing at least one reference value; and (ii) differentiating means for obtaining a count value which is a function of said distance and for determining which of said possible lengths is the length of said at least one of said tags by comparing said count value and said reference value;

(d) said circuit being inoperative for obtaining said length-determining count value until the termination of an initial indicia detect signal corresponding to a trailing portion of an initial one of such indicia, such that said count value and thereby said length is not obtained prior to or during generation of such initial indicia detect signal; and (e) error checking means for comparing said count value with a predetermined maximum value and with a predetermined minimum value and for determining that an error has occurred if said count value exceeds said maximum value or if said count value is less than said minimum value; said differentiating means being operative for determining which of said possible lengths is the length of at least one of said tags only if no error is detected by said error checking means;

wherein the circuit includes means for storing a flag, initializing said flag to an initial value, maintaining said flag at said initial value prior to generation of said initial indicia detect signal, setting said flag to a second value during the generation of said initial indicia detect signal, and beginning the monitoring of said movement upon the termination of said initial indicia detect signal on the condition that said flag is set to said second value.

15. The machine of claim 14, wherein the circuit includes means for storing a movement value which is indicative of said movement, initializing said movement value to an initial value, and maintaining said movement value at said initial value until said monitoring of said movement is begun.

* * * * *